US012135044B2

(12) United States Patent
Bourne

(10) Patent No.: US 12,135,044 B2
(45) Date of Patent: Nov. 5, 2024

(54) MULTIPHASE PUMP

(71) Applicant: Sulzer Management AG, Winterthur (CH)

(72) Inventor: Matthew Bourne, Katy, TX (US)

(73) Assignee: Sulzer Management AG, Winterthur (CH)

( * ) Notice: Subject to any disclaimer, the term of this patent is extended or adjusted under 35 U.S.C. 154(b) by 0 days.

(21) Appl. No.: 16/558,953

(22) Filed: Sep. 3, 2019

(65) Prior Publication Data

US 2020/0088201 A1 Mar. 19, 2020

(30) Foreign Application Priority Data

Sep. 17, 2018 (EP) ..... 18194754.0

(51) Int. Cl.
*F04D 3/00* (2006.01)
*F04D 1/06* (2006.01)
(Continued)

(52) U.S. Cl.
CPC ..... *F04D 3/005* (2013.01); *F04D 9/005* (2013.01); *F04D 13/086* (2013.01);
(Continued)

(58) Field of Classification Search
CPC ..... F04D 3/005; F04D 9/005; F04D 29/181; F04D 29/522; F04D 31/00; F04D 13/086;
(Continued)

(56) References Cited

U.S. PATENT DOCUMENTS 3,268,155 A * 8/1966 Hornschuch ..... F04D 27/0207 415/11
6,135,723 A * 10/2000 Hatton ..... F04C 14/26 417/252
6,514,053 B2 2/2003 Takura et al.
7,338,252 B2 * 3/2008 Meuter ..... F04D 1/063 415/107
2004/0253120 A1 12/2004 Meuter
2007/0177990 A1 * 8/2007 Zacherl ..... F04D 15/0218 417/300

(Continued)

FOREIGN PATENT DOCUMENTS

CN 1308189 A 8/2001
CN 102787817 A 11/2012

(Continued)

OTHER PUBLICATIONS

Extended European Search Report issued Feb. 28, 2019 in corresponding European Patent Application No. 18194754.0, filed Sep. 17, 2018.

*Primary Examiner* — Philip E Stimpert
(74) *Attorney, Agent, or Firm* — Global IP Counselors, LLP

(57) ABSTRACT

A multiphase pump includes a housing having a pump inlet and a pump outlet for a process fluid, an inlet annulus configured to receive the process fluid from the pump inlet, a discharge annulus configured to discharge the process fluid into the pump outlet, a pump rotor configured to rotate about an axial direction and arranged within the housing, the pump rotor being configured to convey the process fluid from the inlet annulus to the outlet annulus, and a return line configured to return the process fluid from the high pressure side to the low pressure side, the return line including an inlet configured to receive the process fluid, an outlet configured to discharge the process fluid and a control valve configured to open and close the return line, the inlet of the return line arranged directly at the discharge annulus.

16 Claims, 4 Drawing Sheets

(51) Int. Cl.

| | |
|---|---|
| ***F04D 9/00*** | (2006.01) |
| ***F04D 13/08*** | (2006.01) |
| ***F04D 15/00*** | (2006.01) |
| ***F04D 29/18*** | (2006.01) |
| ***F04D 29/40*** | (2006.01) |
| ***F04D 29/52*** | (2006.01) |
| ***F04D 31/00*** | (2006.01) |

(52) U.S. Cl.
CPC ..... *F04D 29/181* (2013.01); *F04D 29/40* (2013.01); *F04D 29/522* (2013.01); *F04D 31/00* (2013.01); *F04D 1/06* (2013.01); *F04D 15/0005* (2013.01)

(58) Field of Classification Search
CPC ..... F04D 29/40; F04D 15/0005; F04D 17/08; F04D 27/02; F04D 27/0207; F04D 27/0215; F04D 27/009; F04D 29/605; E21B 43/128
See application file for complete search history.

(56) References Cited

U.S. PATENT DOCUMENTS

| | | | | |
|---|---|---|---|---|
| 2015/0226214 | A1* | 8/2015 | Rohlfing | F04C 13/001 418/1 |
| 2015/0308444 | A1* | 10/2015 | Trottmann | F04D 9/003 415/169.1 |
| 2015/0315884 | A1* | 11/2015 | Hofstad | E21B 41/0085 415/1 |
| 2016/0138595 | A1* | 5/2016 | Becquin | F04D 15/0027 415/58.5 |
| 2017/0102009 | A1* | 4/2017 | Johnson | F04D 13/086 |
| 2017/0260982 | A1* | 9/2017 | Grøtterud | F04B 49/065 |
| 2018/0073509 | A1 | 3/2018 | Madsen | |

FOREIGN PATENT DOCUMENTS

| | | | |
|---|---|---|---|
| EP | 2626563 | A2 | 8/2013 |
| EP | 2626564 | A1 | 8/2013 |
| EP | 3037668 | A1 | 6/2016 |
| JP | 2010031808 | A | 2/2010 |
| WO | 2016077674 | A1 | 5/2016 |

* cited by examiner 1
2
6
94
93
91
9
73
73
7
92
95
5
A
HP
O
4
72
71
72
72
LP
I
3

MULTIPHASE PUMP

CROSS-REFERENCE TO RELATED APPLICATION

This application claims priority to European Patent Application No. 18194754.0, filed Sep. 17, 2018, the content of which is hereby incorporated herein by reference.

BACKGROUND

Field of the Invention

The invention relates to a multiphase pump for conveying a multiphase process fluid.

Background of the Invention

Multiphase pumps are used in many different industries, where it is necessary to convey a process fluid which comprises a mixture of a plurality of phases, for example a liquid phase and a gaseous phase. An important example is the oil and gas processing industry where multiphase pumps are used for conveying hydrocarbon fluids, for example for extracting the crude oil from the oil field or for transportation of the oil/gas through pipelines or within refineries.

SUMMARY

In view of an efficient exploitation of oil- and gas fields there is nowadays an increasing demand for pumps that may be installed and operated directly on the sea ground in particular down to a depth of 100 m, down to 500 m or even down to more than 1,000 m beneath the water's surface. Needless to say that the design of such pumps is challenging, in particular because these pumps shall operate in a difficult subsea environment for a long time period with as little as possible maintenance and service work. This requires specific measurements to minimize the amount of equipment involved and to optimize the reliability of the pump.

Fossil fuels are usually not present in pure form in oil fields or gas fields, but as a multiphase mixture which contains liquid components, gas components and possibly also solid components, such as sand. This multiphase mixture of e.g. crude oil, natural gas and chemicals may also contain seawater and a not unsubstantial proportion of sand and has to be pumped from the oil field or gas field. For such a conveying of fossil fuels, multiphase pumps are used which are able to pump a liquid-gas mixture which may also contain solid components, for example sand.

One of the challenges regarding the design of multiphase pumps is the fact that in many applications the composition of the multiphase process fluid is strongly varying during operation of the pump. For example, during exploitation of an oil field the ratio of the gaseous phase (e.g. natural gas) and the liquid phase (e.g. crude oil) is strongly varying.

These variations may occur very sudden and could cause a drop in pump efficiency, vibrations of the pump or other problems. The ratio of the gaseous phase in the multiphase mixture is commonly measured by the dimensionless gas volume fraction (GVF) designating the volume ratio of the gas in the multiphase process fluid. In applications in the oil and gas industry the GVF may vary between 0% and 100%. These strong variations in the composition of the process fluid could cause that the pump is at least temporarily working outside the operating range the pump is designed for. It is a known measure for reducing the large variations in the GVF to provide a buffer tank upstream of the inlet of a multiphase pump. The multiphase process fluid to be pumped by the multiphase pump is first supplied to a buffer tank of suited volume and the outlet of the buffer tank is connected to the inlet of the pump. By this measure the strong variations of the GVF may be damped thereby improving the pump performance. Modern multiphase pumps in the oil and gas industry may handle multiphase process fluids having a GVF of up to 95% or even more. However, in some applications it might not be reasonable to provide a buffer tank, e.g. due to technical reasons or due to a lack of available space.

But even when using a buffer tank, the variations in the composition of the multiphase process fluid can still be strong so that it cannot be ensured that the multiphase pump is always operating within the operating range which the pump is designed. In particular in the situation of a very high GVF there is a risk that the liquid flow through the pump falls below the minimum flow, at which the pump is operating in a safe, reliable and efficient manner.

In order to protect the pump from operating below the minimum flow of the operating range the pump is designed for several pump protection strategies known in the art, for example, to provide a recycle line or a return line to artificially increase the volumetric flow at the pump inlet. This return line branches off downstream of the pump outlet and leads back to the pump inlet for recycling a part of the process fluid from the high pressure side downstream of the pump outlet back to the suction side or the inlet of the pump at the low pressure side. The return line may be connected to the piping downstream of the pump outlet by a T-piece or any other suited branch off device. The return line comprises a valve for opening or closing the return line. Upon detection of a critical operational state, e.g. a flow that is close to the minimum flow of the operating range of the pump, the valve opens the return line, so that a part of the process fluid is recycled to the suction side of the pump. When the flow through the pump increases and moves away from the minimum required flow, the return line is closed by means of the valve, thus preventing a further recycling of the process fluid to the suction side of the pump. The operation and the control of such a return line is described for example in EP-A-3 037 668.

The performance of such a recycling method or return line is heavily influenced by the fluid properties, for example the density and miscibility of the fluid phases, the GVF, fluid velocity, shear forces, temperature and pressure as well as other external factors such as pipe layout, recycle line scaling, valve position, control feedback lag and valve control.

Thus, depending on the actual conditions it might be that the liquid flow through the return line is too low to ensure reliable operation of the pump.

For improving the performance of such a return line it is a known measure to provide a liquid extraction unit in or upstream of the return line. The liquid extraction unit is for example a static separation device, which tries to separate the liquid out of the multiphase fluid, so that only or mainly the liquid phase of the multiphase fluid is returned to the suction side. However there is the problem that the liquid extraction unit is not really capable of handling the wide range of operational points, e.g. the strong variations in the GVF. It might be that the liquid extraction unit has a very good efficiency at a certain operating point but when moving away from said operating point the performance of the liquid extraction unit rapidly drops off. It might even be that the liquid extraction unit functions as a gas extraction unit at some operating points. Therefore the solution with the liquid extraction unit is not really satisfying in praxis.

Starting from this state of the art it is therefore an object of the invention to propose an improved multiphase pump for conveying a multiphase process fluid, wherein the multiphase pump is better protected from operating below the minimum flow the pump for which it is designed. In particular, the pump shall be suited for subsea applications.

The subject matter of the invention satisfying this object is characterized by the features described herein.

Thus, according to the invention a multiphase pump for conveying a multiphase process fluid from a low pressure side to a high pressure side comprises a housing having a pump inlet and a pump outlet for the process fluid, an inlet annulus designed for receiving the process fluid from the pump inlet, a discharge annulus designed for discharging the process fluid into the pump outlet, a pump rotor for rotating about an axial direction arranged within the housing, with the pump rotor being designed for conveying the process fluid from the inlet annulus to the outlet annulus, and a return line for returning the process fluid from the high pressure side to the low pressure side, wherein the return line comprises an inlet for receiving the process fluid, an outlet for discharging the process fluid and a control valve for opening and closing the return line, and wherein the inlet of the return line is arranged directly at the discharge annulus.

By providing the inlet of the return line directly at the outlet annulus the process fluid entering the return line is very homogeneous. The pump rotor acting on the process fluid creates a very homogeneous mixture of the different phases of the process fluid. In particular, the gas phase is uniformly distributed in the liquid phase. The thoroughly mixed and homogenized process fluid entering the return line has the advantage that a sufficiently high return flow to the low pressure side and to the pump inlet may be achieved thus preventing the pump from operating below the minimum flow that is required for a safe and efficient pump operation. In known solutions, where the return line is branched off downstream of the pump outlet the homogenized process fluid in the discharge annulus has to flow through the pump outlet and additional piping prior to entering the return line. This causes adverse effects in the process fluid to be recycled, such as phase separation, stratification or slug generation. All these adverse separation effects are avoided with the multiphase pump according to the invention, because the process fluid is recycled from a location, namely the discharge annulus, where the homogeneity of the process fluid is the highest.

In addition, due to the homogeneity of the process fluid in the discharge annulus, there is no need for any liquid extraction unit upstream the inlet of the return line or in the return line.

It has to be noted that the return line with its inlet directly arranged at the discharge annulus recycles the process fluid to the low pressure side before the process fluid may pass through any additional component that is wetted by the process fluid and in which rotating parts, i.e. parts of the pump rotor, interact with stationary parts of the pump. The components are for example a balance piston or a bearing for the pump rotor, in particular a bearing lubricated by the process fluid or component(s) of the process fluid. Thus, that process fluid, which is directly returned from the discharge annulus to the low pressure side, does not pass any rotational component, such as a balance piston or a bearing, when flowing from the discharge annulus through the return line.

The arrangement of the inlet of the return line directly at the discharge annulus assures, that thoroughly mixed and homogenized process fluid through normal swirl in the discharge annulus enters the return line. The multiphase pump according to the invention does not require a separate swirl devices or mixing device to ensure that properly mixed and non-separated multiphase process fluid enters the return line. However, the inlet annulus and the discharge annulus may be designed, for example for a specific application, to include swirl devices or other mechanical surfaces to encourage cyclonic or similar effects to further improve the fluid flow conditions into and out of the return line.

In addition, an integrated cyclonic separating device using tangential or centrifugal forces may be disposed in or at the discharge annulus to remove sand or other solid constituents from the process fluid, in order to avoid the recycling of solids to the low pressure side and the inlet annulus, respectively.

Such separating devices, which can be optionally provided in the multiphase pump according to the invention, are for example disclosed in EP-A-2 626 564 or in EP-A-2 626 563. These separating devices are co-rotating with the pump rotor to separate solids, e.g. sand, from the process fluid by centrifugal forces.

According to a preferred embodiment, the inlet of the return line and the pump outlet are disposed in a spaced relationship at the discharge annulus. Thus, the inlet of the return line is a different opening at the discharge annulus than the pump outlet.

Preferably, the outlet of the return line is in fluid communication with the inlet annulus. Thus, the discharge annulus is in fluid communication with the inlet annulus by means of the return line, so that the process fluid may be directly recycled from the discharge annulus to the inlet annulus, when the return line is open.

Furthermore, it is preferred, that the outlet of the return line is arranged directly at the inlet annulus.

According to other embodiments it is also possible, that a buffer tank is disposed between the discharge annulus and the inlet annulus so that the process fluid recycled through the return line first enters the buffer tank and is then supplied from the buffer tank to the low pressure side of the pump for entering the inlet annulus.

According to an advantageous measure, the outlet of the return line and the pump inlet are disposed in a spaced relationship at the inlet annulus. Thus, the outlet of the return line is a different opening at the inlet annulus than the pump inlet.

According to a preferred embodiment the return line directly couples the discharge annulus with the inlet annulus, i.e. beside the control valve for opening and closing the return line there is no other device arranged in the return line. The return line is for example a single pipe directly connecting the discharge annulus with the inlet annulus.

According to a preferred design the return line is as short as it is reasonably possible. In particular, the return line has a length, which is at most two times, preferably at most 1.5 times, the distance between the pump inlet and the pump outlet. Thus, it is strived for minimizing the length of the return line. Ideally, the length of the return line corresponds essentially to the distance between the discharge annulus and the inlet annulus. However, depending on the respective design or the respective configuration of the pump and depending on how the return line is coupled to the discharge annulus and the inlet annulus, the total length of the return line may be—in practice—somewhat greater than the distance between the discharge annulus and the inlet annulus.

According to this preferred design the return line is configured to have the shortest length that is constructively possible or reasonable.

The short length of the return line has several advantages: By the short length of the return line separation effects such as stratification, phase separation or slug generation in the recycled process fluid in the return line are avoided or at least considerably reduced. In addition, the short length cause only very low pressure losses along the return line resulting from friction losses in the return line. Furthermore, the thermal variance of the process fluid in the return line as compared to the main stream of the process fluid through the pump is very low, for example the temperature of the process fluid in the return line is at least very similar to the temperature of the process fluid conveyed by the pump rotor from the inlet annulus to the discharge annulus. Both the low pressure drop over the return line and the low thermal variance help to prevent the formation of hydrates.

According to a preferred embodiment the return line is detachably connected with the housing, for example by means of a flange connection.

In a preferred embodiment the return line is designed as an external pipe arranged at the outside of the housing.

In another preferred embodiment the return line is arranged inside the housing.

The multiphase pump according to the invention may be designed as a vertical pump with the pump rotor extending in the vertical direction. Alternatively, the multiphase pump according to the invention may be designed as a horizontal pump with the pump rotor extending perpendicular to the vertical direction, i.e. in horizontal direction.

According to a preferred configuration the multiphase pump comprises a drive unit operatively connected to the pump rotor for rotating the pump rotor, wherein the drive unit is arranged inside the housing.

In particular, the multiphase pump may be designed for subsea oil and gas conveyance.

In a preferred embodiment the multiphase pump is designed for installation on the sea ground.

Further advantageous measures and embodiments of the invention will become apparent from the dependent claims.

BRIEF DESCRIPTION OF THE DRAWINGS

The invention will be explained in more detail hereinafter with reference to the drawings.

DETAILED DESCRIPTION OF THE EMBODIMENTS

Figure 1:
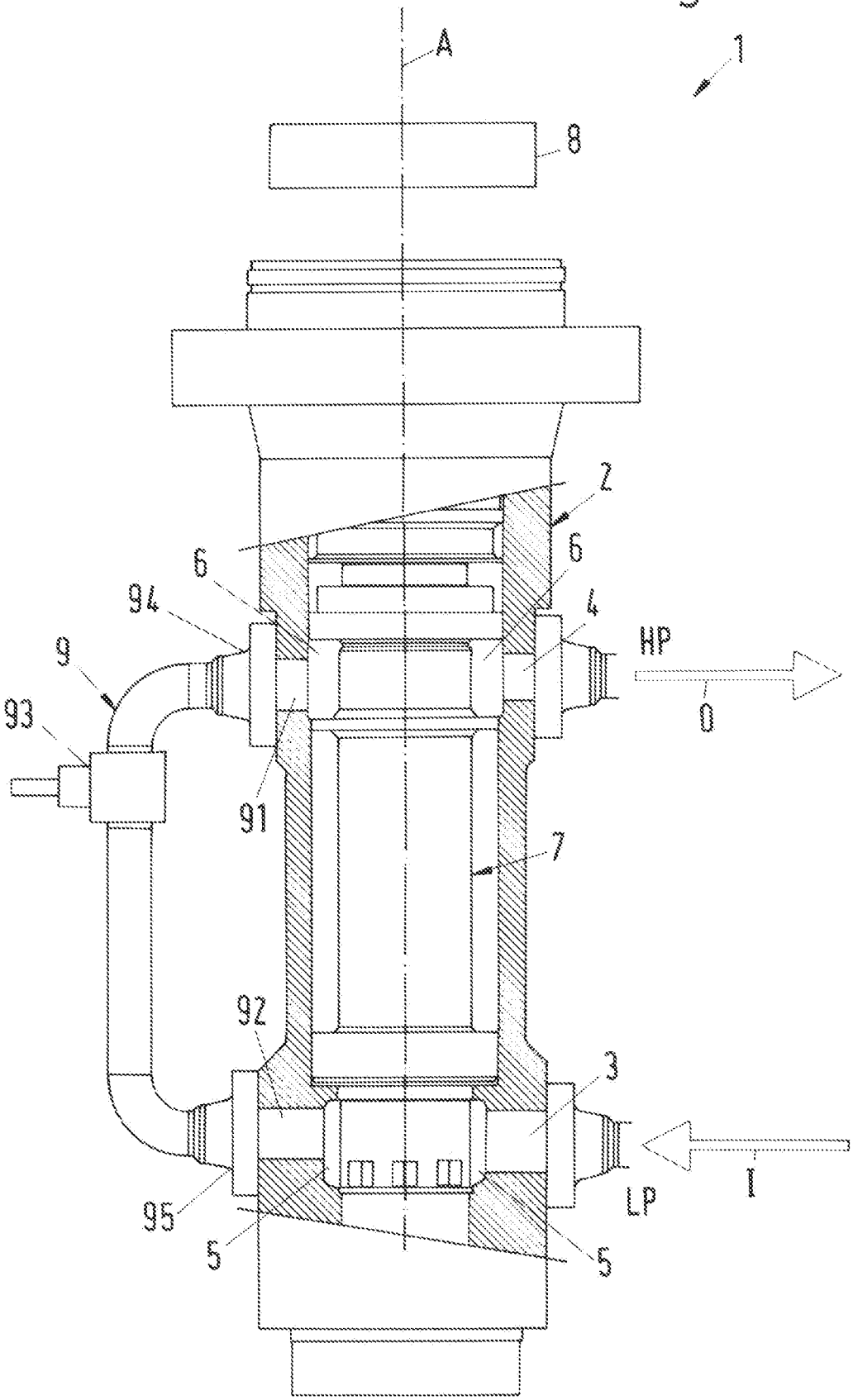
FIG. 1 is a cross-sectional view of a first embodiment of a multiphase pump according to the invention.

FIG. 1 shows a cross-sectional view of an embodiment of a multiphase pump according to an embodiment of the invention which is designated in its entity with reference numeral 1. The multiphase pump 1 is designed as a centrifugal pump for conveying a multiphase process fluid from a low pressure side LP to a high pressure side HP. The multiphase pump 1 has a housing 2 designed as a pressure housing, which is able to withstand the pressure generated by the pump 1 as well as the pressure exerted on the pump 1 by the environment. The housing 2 may comprise several housing parts, which are connected to each other to form the housing 2.

In the following description reference is made by way of example to the important application that the multiphase pump 1 is designed and adapted for being used as a subsea pump in the oil and gas industry. In particular, the multiphase pump 1 is configured for installation on the sea ground, i.e. for use beneath the water-surface, in particular down to a depth of 100 m, down to 500 m or even down to more than 1000 m beneath the water-surface of the sea. In such applications the multiphase process fluid is typically a hydrocarbons containing mixture that has to be pumped from an oilfield for example to a processing unit beneath or on the water-surface or on the shore. The multiphase mixture constituting the process fluid to be conveyed can include a liquid phase, a gaseous phase and a solid phase, wherein the liquid phase can include crude oil, seawater and chemicals, the gas phase can include methane, natural gas or the like and the solid phase can include sand, sludge and smaller stones without the multiphase pump 1 being damaged on the pumping of the multiphase mixture.

It goes without saying that the invention is not restricted to this specific example but is related to multiphase pumps in general. The invention may be used in many different applications, especially in such applications where the multiphase pump 1 is installed at locations which are difficult to access.

The housing 2 of the multiphase pump 1 comprises a pump inlet 3 through which the multiphase process fluid enters the pump 1 at the low pressure side LP as indicated by the arrow I, and a pump outlet 4 for discharging the process fluid with an increased pressure at the high pressure side HP as indicated by the arrow O. Typically the pump outlet 4 is connected to a pipe or a piping (not shown) for delivering the process fluid to another location. The pressure of the process fluid at the pump outlet 4, i.e. at the high pressure side HP, is typically considerably higher than the pressure of the process fluid at the pump inlet 3, i.e. at the low pressure side LP. A typical value for the difference between the high pressure and the low pressure side is for example 50 to 200 bar.

The pump 1 further comprises an inlet annulus 5. The pump inlet 3 opens into the inlet annulus 5, so that the inlet annulus 5 receives the process fluid through the pump inlet 3. The pump 1 further comprises a discharge annulus 6 for discharging the process fluid into the pump outlet 4, through which the process fluid leaves the pump 1. The pump outlet 4 opens into the discharge annulus 6.

The multiphase pump further comprises a pump rotor 7 for rotating about an axial direction A. In a manner known per se the pump rotor 7 is configured for conveying the process fluid from the inlet annulus 5 at the low pressure side LP to the discharge annulus 6 at the high pressure side HP. The details of the pump rotor 7 are not shown in FIG. 1. Typically, the pump rotor 7 comprises a shaft 71 (see for example FIG. 2) rotatable about the axial direction A and one impeller 72 (single stage pump) or a plurality of impellers 72 (multistage pump) arranged in series along the axial direction A for conveying the process fluid from the inlet annulus 5 to the discharge annulus 6 and thereby increasing the pressure of the process fluid. Each impeller 72 is fixed to the shaft 71 in a torque-proof manner. Each impeller 72 may be designed for example as a radial impeller or as an axial impeller or as a semi-axial impeller.

For rotating the shaft 71 of the pump rotor 7, the shaft 71 is operatively connected to a drive unit 8, which might be a separate unit located outside the housing 2 of the pump, or which might be integrated into the housing 2. For subsea applications the drive unit 8 is usually arranged inside the housing 2.

By the drive unit 8 the pump rotor 7 is driven during operation of the pump 1 for a rotation about the axial direction A that is defined by the longitudinal axis of the pump rotor 7.

The multiphase pump 1 further comprises a return line 9 for recycling a part of the process fluid from the high pressure side HP to the low pressure side LP. The return line 9 comprises an inlet 91 for receiving the process fluid to be recycled, an outlet 92 for discharging the process fluid to be recycled, and a control valve 93 for opening and closing the return line 9. The control valve 93 may be designed for example as a minimum flow valve, which opens the return line 9 when the flow generated by the pump 1 drops below a minimum flow.

According to the invention, the inlet 91 of the return line 9 is arranged directly at the discharge annulus 6, so that the return line 9 receives the process fluid directly from the discharge annulus 6. The multiphase process fluid in the discharge annulus 6 is strongly homogenized by the action of the pump rotor 7, which thoroughly mixes at least the liquid and the gaseous phase of the multiphase fluid.

In the embodiment shown in FIG. 1 the inlet 91 of the return line 9 opens into the discharge annulus 6, so that the process fluid may directly enter the inlet 91 of the return line 9 from the discharge annulus 6.

The inlet 91 of the return line 9 and the pump outlet 4 are disposed in a spaced relationship at the discharge annulus 6. Typically, the discharge annulus 6 is an annular chamber. As shown in FIG. 1 the inlet 91 of the return line 9 and the pump outlet 4 are arranged diametrically opposed at the discharge annulus 6.

It has to be noted that the distance between the inlet 91 of the return line 9 and the pump outlet 4 at the discharge annulus 6 may be different from 180° when viewed in the circumferential direction of the discharge annulus 6. However, the opening of the inlet 91 into the discharge annulus 6 is a different opening than the opening of the pump outlet 4 into the discharge annulus 6.

The outlet 92 of the return line 9 is in fluid communication with the inlet annulus 5 of the pump 1. According to the embodiment shown in FIG. 1, the outlet 92 of the return line 9 is arranged directly at the inlet annulus 5. The outlet 92 opens into the inlet annulus 5.

The outlet 92 of the return line 9 and the pump inlet 3 are disposed in a spaced relationship at the inlet annulus 5. Typically, the inlet annulus 5 is an annular chamber. As shown in FIG. 1 the outlet 92 of the return line 9 and the pump inlet 3 are arranged diametrically opposed at the inlet annulus 5.

It has to be noted that the distance between the outlet 92 of the return line 9 and the pump inlet 3 at the inlet annulus 5 may be different from 180° when viewed in the circumferential direction of the inlet annulus 5. However, the opening of the outlet 92 into the inlet annulus 5 is a different opening than the opening of the pump inlet 3 into the inlet annulus 5.

The return line 9 is designed as a pipe connecting the discharge annulus 6 with the inlet annulus 5. In the first embodiment shown in FIG. 1 the return line 9 is designed as an external pipe and arranged at the outside of the housing 2. The return line 9 is fixed to the housing 2 by means of a first flange connection 94 connecting the inlet 91 of the return line 9 with the discharge annulus 6, and by means of a second flange connection 95 connecting the outlet 92 of the return line 9 with the inlet annulus 5.

The return line 9 is designed as a pipe having the shortest length that is possible or technically reasonable when considering constructional or structural aspects. Ideally, the length of the pipe constituting the return line is essentially the same as the distance between the discharge annulus 6 and the inlet annulus 5. In practice, the return line 9 is somewhat longer than the distance between the discharge annulus 6 and the inlet annulus 5 due to constructional reasons. It is preferred that the return line 9 has a length which is at most two times and particularly preferred at most 1.5 times the distance between the pump inlet 3 and the pump outlet 4. The short and compact design of the return line 9 has the advantage that the pressure loss caused by friction losses in the return line 9 is very low. In addition the short length of the return line 9 reduces any separation effects in the recycled process fluid, such as phase separation, stratification or slug generation. Furthermore, by the short length of the return line 9 considerable temperature variations between the recycled process fluid and the main stream of process fluid are avoided. Due to the low pressure losses and the low thermal variations the formation of hydrates, in particular in the return line 9, is prevented As already said, the return line 9 further comprises the control valve 93 for opening and closing the return line 9. When the control valve 93 is in the open position the fluid communication through the return line 9 is open, so that the process fluid is recycled from the discharge annulus 6 to the low pressure side LP. When the control valve 93 is in the close position the fluid communication through the return line 9 is closed, so that no process fluid is recycled from the discharge annulus 6 to the low pressure side LP. The control valve 93 may be designed as a shut-off valve having only an open and a close position or the control valve 93 may be designed as a flow control valve for regulating the flow of the process fluid through the return line 9.

The control valve 93 may be configured for example as an electrically actuated valve or as a hydraulically actuated valve.

The method for operating the return line 9, in particular how and when the return line 9 is opened or closed by the control valve 93, per se is not particularly relevant for the invention. In principle, each method known in the art for operating a return line 9 in a pump, in particular in a multiphase pump 1, is suited for operating the multiphase pump 1 according to the invention. As an example reference is made to EP-A-3 037 668 where a method is described for operating a pump having a return line for recycling the process fluid from the high pressure side to the low pressure side or the suction side of the pump.

The basic function of the return line 9 is to avoid, that the multiphase pump 1 is operating at a flow, which is lower than the minimum flow the multiphase pump 1 is designed for. This minimum flow is a known value, which is given by the design of the pump 1 or the pump installation.

During operation of the multiphase pump 1 the hydraulic performance of the pump 1 is monitored. For example the flow generated by the pump is detected, for example by determining the flow of process fluid discharged through the pump outlet 4. The flow may be directly measured by means of one or more appropriate sensors or the flow may be determined by means of other operational parameters of the pump 1 which are indicative for or related to the flow generated by the pump 1.

When the flow approaches or reaches the minimum flow the return line 9 is partially or fully opened by means of the control valve 93. Now, the process fluid is at least partially recycled from the high pressure side HP to the low pressure side LP or the suction side, respectively, of the pump 1. Of course, it is also possible that the entire flow of process fluid conveyed to the discharge annulus 6 is returned to the inlet annulus 5.

By returning the process fluid from the high pressure side HP to the pump inlet 3 or to the inlet annulus, respectively, the volume flow at the pump inlet 4 or through the inlet annulus 5 is increased, whereby the flow through the pump 1 from the inlet annulus 5 to the discharge annulus 6 is increased, which moves the actual operating pump away from the minimum flow condition back towards the best efficiency point. As soon as the flow of process fluid generated by the pump 1 is sufficiently higher than the minimum flow, the return line 9 can be closed by means of the control valve 93, so that the process fluid is no longer recycled from the discharge annulus 6 to the low pressure side LP of the pump.

For recycling the process fluid from the discharge annulus 6 to the low pressure side LP of the pump it is not necessary to supply the recycled process fluid directly to the inlet annulus 5 through an opening that is different from the orifice of the pump inlet 3 into the inlet annulus 5.

In other embodiment of the pump 1 the outlet 92 of the return line 9 is connected to the pump inlet 3.

In addition, it is also possible that the return line 9 is connected to a buffer tank and the buffer tank is connected with the pump inlet 3. In such embodiments the process fluid recycled from the discharge annulus 6 is supplied to the buffer tank. From the buffer tank the process fluid is supplied to the pump inlet 3.

The embodiment shown in FIG. 1 is configured as a vertical pump with the pump rotor 7 extending in the vertical direction. During operation of the pump the pump rotor 7 is oriented in the direction of gravity and the axial direction A extends vertically.

It goes without saying that the multiphase pump according to the invention may also be designed as a horizontal pump with the pump rotor 7 extending in the horizontal direction, i.e. perpendicular to the direction of gravity.

In the following description of further embodiments of the multiphase pump 1 according to the invention only the differences to the first embodiment are explained in more detail. The explanations with respect to the first embodiment are also valid in the same way or in analogously the same way for the other embodiments. Same reference numerals designate features that have been explained with reference to FIG. 1 or functionally equivalent features. In addition, the features explained referring to a specific embodiment may also be implemented in an analogous way in the respective other embodiments. In particular each of the embodiments may be designed as a vertical pump or as a horizontal pump.

Figure 2:
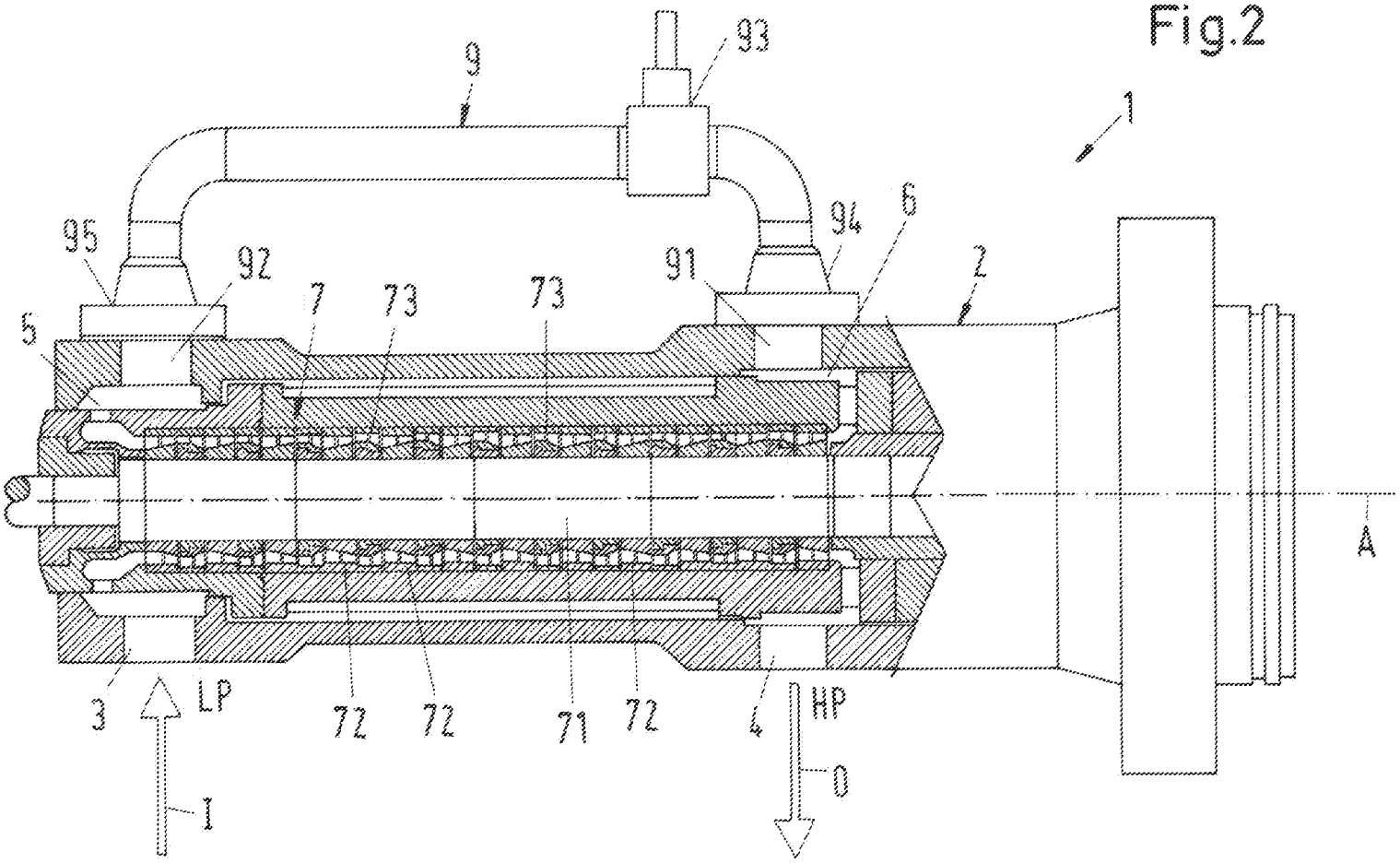
FIG. 2 is a cross-sectional view of a second embodiment of a multiphase pump according to the invention.

FIG. 2 shows a cross-sectional view of a second embodiment of a multiphase pump 1 according to the invention. The second embodiment is designed as a horizontal pump 1. The multiphase pump 1 is designed as a multistage pump 1, wherein the pump rotor 7 comprises a plurality of impellers 72 arranged in series on the shaft 71. The impellers 72 are designed as semi-axial impellers 72. Between adjacent impellers 72 in each case a stationary diffuser 73 is provided for directing the process fluid to the next stage impeller 72. The drive unit 8 for rotating the pump rotor 7 is not shown in FIG. 2.

Figure 3:
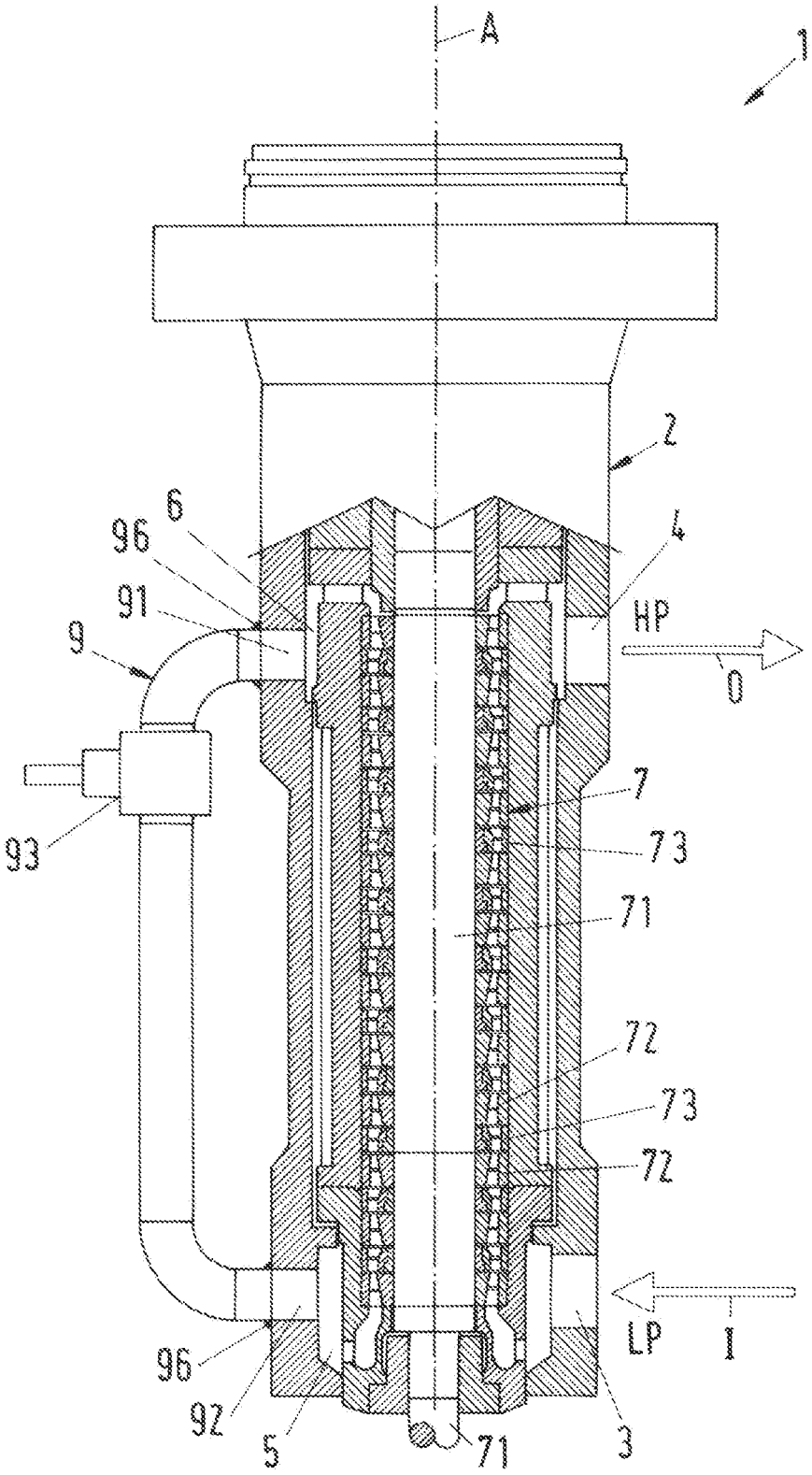
FIG. 3 is a cross-sectional view of a third embodiment of a multiphase pump according to the invention.

FIG. 3 shows a cross-sectional view of a third embodiment of a multiphase pump 1 according to the invention. The third embodiment is here designed as a vertical pump. The drive unit 8 for rotating the pump rotor 7 is not shown in FIG. 3.

According to the third embodiment the return line 9 is fixedly connected to the housing 2 in a non-detachable manner. The return line 9 is for example welded to the housing 2 as indicated by the welding seams 96 in FIG. 3.

Figure 4:
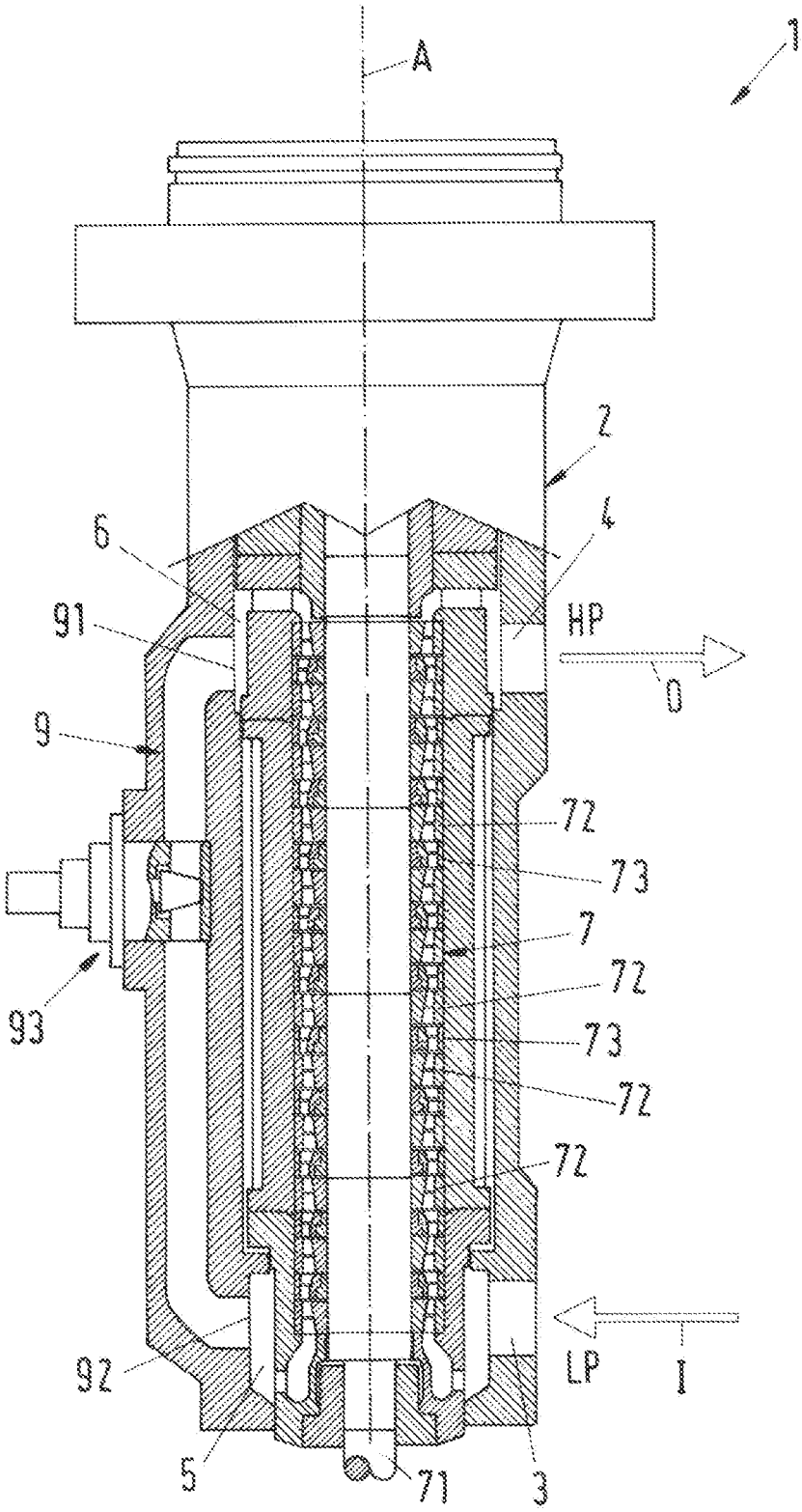
FIG. 4 is a cross-sectional view of a fourth embodiment of a multiphase pump according to the invention.

FIG. 4 shows a cross-sectional view of a fourth embodiment of a multiphase pump 1 according to the invention. The fourth embodiment is here designed as a vertical pump. The drive unit 8 for rotating the pump rotor 7 is not shown in FIG. 4.

In the fourth embodiment the return line 9 is an internal line, i.e. the return line 9 is arranged inside the housing 2 of the multiphase pump 1.

What is claimed:

1. A multiphase pump for conveying a multiphase process fluid from a low pressure side to a high pressure side, the multiphase process fluid including liquid components and gas components, the multiphase pump comprising:

a housing having a pump inlet and a pump outlet for the process fluid and configured to be connected to a pipe to deliver the process fluid to another location;

an inlet annulus configured to receive the process fluid from the pump inlet;

a discharge annulus configured to discharge the process fluid into the pump outlet;

a pump rotor configured to rotate about an axial direction and arranged within the housing, the pump rotor having an impeller and being configured to convey the process fluid from the inlet annulus to the discharge annulus with the discharge annulus being a chamber separate from the pump rotor; and a return line configured to return the process fluid from the high pressure side to the low pressure side, the return line comprising an inlet configured to receive the process fluid, an outlet configured to discharge the process fluid and a control valve configured to open and close the return line, the inlet of the return line arranged directly at the discharge annulus so as to enable the liquid components and gas components of the process fluid to be in a homogenous state when entering the return line and the outlet of the return line arranged directly at the inlet annulus, the return having a length to enable the liquid components and gas components of the process fluid to be mixed at the outlet of the return line, and at least a portion of the inlet annulus surrounding the impeller in a radial direction.

2. The multiphase pump in accordance with claim 1, wherein the inlet of the return line and the pump outlet are disposed in a spaced relationship at the discharge annulus.

3. The multiphase pump in accordance with claim 1, wherein the outlet of the return line is in fluid communication with the inlet annulus.

4. The multiphase pump in accordance with claim 1, wherein the outlet of the return line and the pump inlet are disposed in a spaced relationship at the inlet annulus.

5. The multiphase pump in accordance with claim 1, wherein the return line directly couples the discharge annulus with the inlet annulus.

6. The multiphase pump in accordance with claim 1, wherein the return line has a length, which is at most two times the distance between the pump inlet and the pump outlet.

7. The multiphase pump in accordance with claim 1, wherein the return line is detachably connected with the housing.

8. The multiphase pump in accordance with claim 1, wherein the return line is an external pipe arranged at an outside of the housing.

9. The multiphase pump in accordance with claim 1, wherein the return line is arranged inside the housing.

10. The multiphase pump in accordance with claim 1, wherein the multiphase pump is a vertical pump with the pump rotor extending in a vertical direction.

11. The multiphase pump in accordance with claim 1, further comprising a driver operatively connected to the pump rotor and configured to rotate the pump rotor, the driver arranged inside the housing.

12. The multiphase pump in accordance with claim 1, wherein the multiphase pump is configured for subsea oil and gas conveyance.

13. The multiphase pump in accordance with claim 1, wherein the multiphase pump is configured for installation on a sea ground.

14. The multiphase pump in accordance with claim 1, wherein the return line has a length, which is at most 1.5 times the distance between the pump inlet and the pump outlet.

15. The multiphase pump in accordance with claim 1, wherein the inlet of the return line and the pump outlet are arranged diametrically opposed at the discharge annulus.

16. The multiphase pump in accordance with claim 1, wherein the outlet of the return line and the pump inlet are arranged diametrically opposed at the inlet annulus.

* * * * *